US007623087B2

(12) United States Patent
Higaki et al.

(10) Patent No.: US 7,623,087 B2
(45) Date of Patent: Nov. 24, 2009

(54) HIGH-IMPEDANCE SUBSTRATE, ANTENNA DEVICE AND MOBILE RADIO DEVICE

(75) Inventors: Makoto Higaki, Kawasaki (JP); Kazuhiro Inoue, Inagi (JP); Shuichi Sekine, Yokohama (JP); Akihiro Tsujimura, Ome (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 11/950,525

(22) Filed: Dec. 5, 2007

(65) Prior Publication Data

US 2008/0150825 A1 Jun. 26, 2008

(30) Foreign Application Priority Data

Dec. 25, 2006 (JP) ..... 2006-348380

(51) Int. Cl.
*H01Q 15/02* (2006.01)
*H01Q 15/24* (2006.01)

(52) U.S. Cl. ..... 343/909; 343/702; 343/846

(58) Field of Classification Search ..... 343/909, 343/702, 846
See application file for complete search history.

(56) References Cited

U.S. PATENT DOCUMENTS

| | | | | |
|---|---|---|---|---|
| 6,262,495 | B1 * | 7/2001 | Yablonovitch et al. | 307/101 |
| 2003/0010529 | A1 | 1/2003 | Sievenpiper et al. | |
| 2003/0112186 | A1 | 6/2003 | Sanchez et al. | |
| 2004/0160367 | A1 * | 8/2004 | Mendolia et al. | 343/700 MS |
| 2005/0029632 | A1 * | 2/2005 | McKinzie et al. | 257/665 |
| 2005/0068233 | A1 | 3/2005 | Tanaka et al. | |

FOREIGN PATENT DOCUMENTS

| | | | |
|---|---|---|---|
| JP | 2002-510886 | | 4/2002 |
| JP | 2003-529261 | | 9/2003 |
| JP | 2004-535720 | | 11/2004 |
| JP | 2005-79794 | | 3/2005 |
| JP | 2005-94360 | | 4/2005 |
| JP | 2005-110273 | | 4/2005 |
| WO | WO94/13029 | * | 6/1994 |
| WO | WO 94/13029 | | 6/1994 |
| WO | WO 99/50929 | | 10/1999 |
| WO | WO 01/73893 A1 | | 10/2001 |

(Continued)

OTHER PUBLICATIONS

U.S. Appl. No. 12/170,733, filed Jul. 10, 2008, Sekine, et al.

(Continued)

*Primary Examiner*—Anh Q Tran
(74) *Attorney, Agent, or Firm*—Oblon, Spivak, McClelland, Maier & Neustadt, L.L.P.

(57) ABSTRACT

There is provided with a high-impedance substrate including: a finite ground plane; a plurality of metal plates arranged at a predetermined height from the finite ground plane and in a matrix pattern such that respective faces thereof are approximately parallel to the finite ground plane; and a plurality of linear conductive elements configured to connect the plurality of metal plates to the finite ground plane and, wherein outer metal plates arranged at an outermost periphery among the plurality of metal plates are connected with the linear conductive elements at edges of the outer metal plates.

16 Claims, 9 Drawing Sheets

FOREIGN PATENT DOCUMENTS

| | | | |
|---|---|---|---|
| WO | WO 02/41447 | A1 | 5/2002 |
| WO | WO 03/007427 | A1 | 1/2003 |
| WO | WO 2008/020249 | A1 | 2/2008 |

OTHER PUBLICATIONS

U.S. Appl. No. 12/188,522, filed Aug. 8, 2008, Inoue, et al.

Hisamatsu Nakano, et al., "A Dual-Frequency Spiral Antenna", Institute of Electronics, Information and Communication Engineers General Meeting B-1, Mar. 3, 2003, p. 135.

U.S. Appl. No. 12/410,768, filed Mar. 25, 2009, Suetsuna, et al.

Japanese Office Action with English, Jul. 4, 2009.

* cited by examiner

HIGH-IMPEDANCE SUBSTRATE, ANTENNA DEVICE AND MOBILE RADIO DEVICE

CROSS REFERENCE TO RELATED APPLICATIONS

This application is based upon and claims the benefit of priority from the prior Japanese Patent Applications No. 2006-348380, filed on Dec. 25, 2006; the entire contents of which are incorporated herein by reference.

BACKGROUND OF THE INVENTION

1. Field of the Invention

The present invention relates to a high-impedance substrate, an antenna device and a mobile radio device, and relates to, for example, a technique for downsizing high-impedance substrates.

2. Related Art

As described in National Publication of International Patent Application No. 2004-535720, a conventional high-impedance substrate has a structure in which a large number of metal patches (metal plates) are periodically arranged. One conventional issue that can be surmounted by such a high-impedance substrate is the adoption of a low profile for an antenna on a conductor plate. National Publication of International Patent Application No. 2004-535720 utilizes its advantages to achieve a low-profile antenna on the rooftop of an automobile, thereby solving the conventional problems existing in vehicle-mounted antennas with respect to mechanical strength and aesthetic properties. However, since a large-area is assumed for mounting of such a conventional high-impedance substrate, mounting on a small-sized device is difficult. In particular, mounting a conventional high-impedance substrate on extremely small devices such as a mobile phone is difficult even if the substrate includes only two rows of metal patches.

As described above, a conventional high-impedance substrate has a problem in that mounting on a small-sized device is difficult.

SUMMARY OF THE INVENTION

According to a first aspect of the present invention, there is provided with a high-impedance substrate comprising:

a finite ground plane;

a plurality of metal plates arranged at a predetermined height from the finite ground plane and in a matrix pattern such that respective faces thereof are approximately parallel to the finite ground plane; and a plurality of linear conductive elements configured to connect the plurality of metal plates to the finite ground plane and, wherein outer metal plates arranged at an outermost periphery among the plurality of metal plates are connected with the linear conductive elements at edges of the outer metal plates.

According to a second aspect of the present invention, there is provided with an antenna device comprising the high-impedance substrate according to the first aspect of the present invention and a monopole antenna or a dipole antenna at the predetermined height from the finite ground plane or at a higher height.

According to a third aspect of the present invention, there is provided with a portable radio device comprising:

a high-impedance substrate including a finite ground plane, a plurality of metal plates arranged at a predetermined height from the finite ground plane and in a matrix pattern such that respective faces thereof are approximately parallel to the finite ground plane, and a plurality of linear conductive elements configured to connect the plurality of metal plates to the finite ground plane and, wherein outer metal plates arranged at an outermost periphery among the plurality of metal plates are connected with the linear conductive elements at edges of the outer metal plates;

an antenna arranged at a predetermined height from the finite ground plane or at a higher height;

a radio circuit configured to generate high-frequency current; and a feeding line configured to supply high-frequency current generated by the radio circuit to a feeding point of the antenna.

According to a fourth aspect of the present invention, there is provided with a high-impedance substrate comprising:

a finite ground plane;

a plurality of metal plates arranged at a predetermined height from the finite ground plane and in a matrix pattern such that respective faces thereof are approximately parallel to the finite ground plane; and a plurality of linear conductive elements configured to connect the plurality of metal plates to the finite ground plane, wherein a planar area of outer metal plates arranged at an outermost periphery among the plurality of metal plates is smaller than a planar area of other metal plates different from the outer metal plates.

According to a fifth aspect of the present invention, there is provided with a high-impedance substrate comprising:

a finite ground plane;

2 by "n" (where "n" is an integer equal to or greater than 2) number of metal plates arranged at a predetermined height from the finite ground plane and in a 2-row matrix pattern such that respective faces thereof are approximately parallel to the finite ground plane; and 2 by "n" number of linear conductive elements configured to connect the metal plates to the finite ground plane and, wherein first metal plates arranged at corners among the 2 by "n" number of metal plates are connected with the linear conductive elements at intersections of sides on which an adjacent metal plate does not exist, and second metal plates other than the first metal plates among the 2 by "n" number of metal plates are connected with linear conductive elements at a side on which an adjacent metal plate does not exist.

DETAILED DESCRIPTION OF THE INVENTION

Embodiments will now be described in detail with reference to the drawings.

First Embodiment

Figure 1:
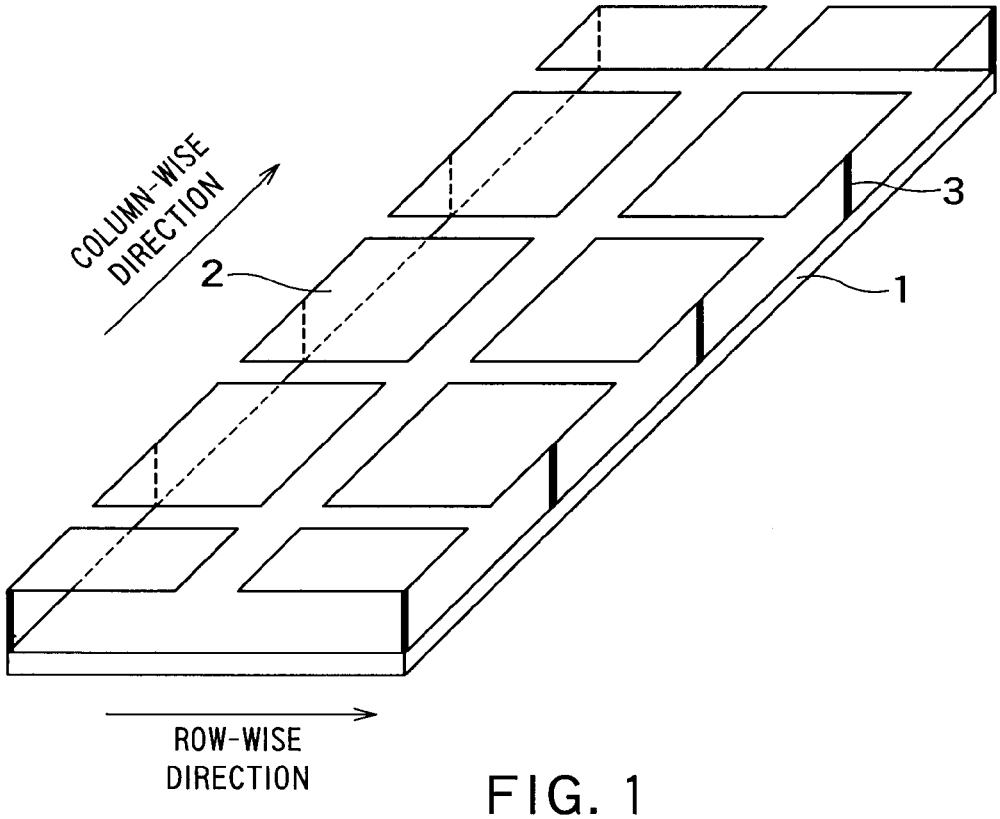
FIG. 1 is a configuration diagram of a high-impedance substrate according to a first embodiment.

FIG. 1 is a perspective view showing a configuration of a high-impedance substrate according to a first embodiment of the present invention. This high-impedance substrate includes a finite ground plane 1, rectangular metal patches (metal plates) 2 periodically-arranged in two rows (arranged in a 2-row, 5-column matrix pattern) on the finite ground plane 1, and linear conductors (linear conductive elements) 3 that short-circuit the finite ground plane 1 and the metal patches 2.

The finite ground plane 1 is made of conducting material. Since the essence of the realization of a high-impedance substrate lies in the arrangement of the metal patches 2, the area of the finite ground plane 1 is nonessential. Therefore, while FIG. 1 shows the area of the finite ground plane 1 to be equivalent to the area over which the metal patches are arranged in order to attain maximum downsizing of the overall configuration, the area of the finite ground plane 1 may just as well be greater than the arrangement area.

The metal patches 2 are made of conducting material having a rectangular planar shape. The two rows of metal patches are respectively periodically-arranged, and a high-impedance substrate can be realized at an arbitrary frequency band by varying the distance of the metal patches from the finite ground plane, the spacing between the metal patches, the area of a metal patch or the like. In this case, the distance from the finite ground plane need only be shorter than ¼ wavelength of the frequency, and the spacing between the metal patches, the area of a metal patch and the like need only be determined so as to satisfy known relational expressions. The plane of the metal patches 2 is approximately parallel to the plane of the finite ground plane 1. The metal patches on both ends of each column are configured to be half as long in the column-wise direction. While an example having a total of 10 metal patches in 2 rows by 5 columns is shown in FIG. 1, the numbers of rows and columns are not limited to this example and may instead be increased or reduced according to implementation conditions. In particular, forming a matrix of four (2 rows by 2 columns) metal patches is certainly acceptable.

The linear conductors 3 are made of conducting material, and short-circuit the above-described finite ground plane 1 and the metal patches 2. The linear conductors 3 are connected at edges of the metal patches 2. More specifically, metal patches (first metal patches) 2 arranged at corners (intersections of columns and rows) are connected with linear conductors 3 at intersections of sides on which an adjacent metal patch does not exist, while metal patches (second metal patches) 2 arranged at portions other than a corner (an intersection of a column and a row) are connected with linear conductors 3 at the center of a side on which an adjacent metal patch does not exist.

The above configuration provides the high-impedance substrate shown in FIG. 1 with high-impedance characteristics. A principle of operation of this high-impedance substrate will now be described.

Figure 10:
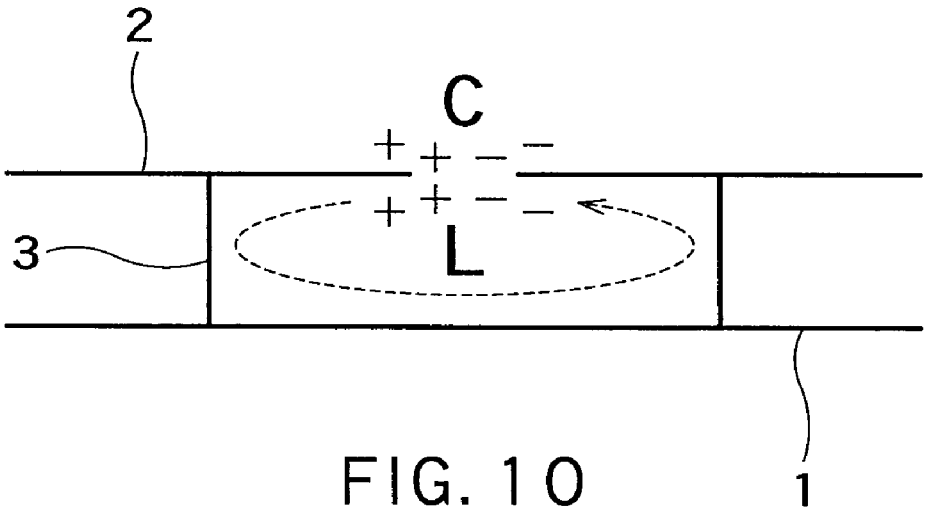
FIG. 10 is a schematic diagram for explaining a principle of operation of a high-impedance substrate.

FIG. 10 is a schematic diagram of a high-impedance substrate shown in FIG. 1 seen from a direction parallel to the finite ground plane 1. This diagram extracts metal patches 2 and linear conductors 3 corresponding to one period. As shown, electrical charges tend to accumulate in a proximity of two adjacent metal patches 2 due to a high-frequency current. This proximity can be considered to be an equivalent circuit of a capacitance C. On the other hand, a phase-change occurs on a pathway passing through the finite ground plane 1 that is opposite to the capacitance C. Therefore, this pathway can be considered to be an equivalent circuit of an inductance L. Accordingly, since the entire structure shown in FIG. 1 is effectively a parallel circuit of L and C, a frequency band exists which causes antiresonance in a direction parallel to the finite ground plane 1. In such a frequency band, a high-impedance state occurs, and high-frequency currents that were generated only with the finite ground plane having no metal patches can be suppressed.

The background that prompted the inventors to achieve the present invention will now be described with reference to FIGS. 11 and 12.

Figure 11:
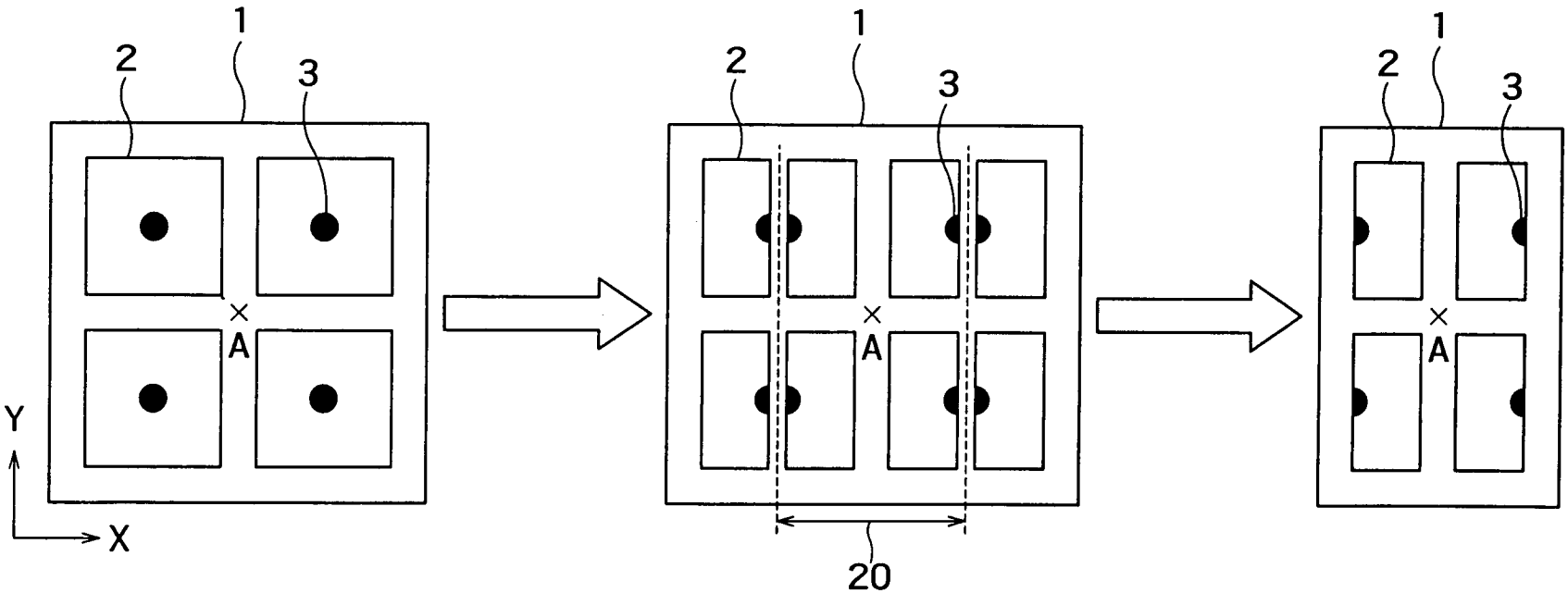
FIG. 11 is a diagram explaining the background leading to the present invention.

The left diagram in FIG. 11 shows a 1-period (2-row), 1-period (2-column) high-impedance substrate seen from a side that is perpendicular to the finite ground plane 1 and which includes the metal patches 2. The four metal patches 2 have quadrature planar shapes and are short-circuited at centers thereof by linear conductors 3 to the finite ground plane 1. Since the structure is rotationally symmetric, high-impedance characteristics can be achieved at the same frequency hand with respect to high-frequency currents in both the directions "X" and "Y" depicted in the diagram. In this state, as shown in the center diagram, the respective metal patches 2 are bisected at planes passing through the linear conductors 3. At this point, if it is granted that the gaps between the bisected portions are sufficiently narrow, it is safe to assume that the respective bisected portions are short-circuited with respect to high frequencies. Consequently, the structure shown in the center diagram is capable of performing exactly the same operations as those performed by the structure shown in the left diagram. A portion 20 shown in the center diagram, which is now considered to be one period, is extracted and shown in the right diagram. Since one period in the "X" direction was extracted, the high-impedance characteristics in the "Y" direction are the same as that of the center diagram. On the other hand, from the perspective of the basic principle of operation shown in FIG. 10, when considering an equivalent circuit in the "X" direction, the end-halves of the metal patches 2 in the "X" direction are unnecessary. Therefore, the right diagram has high-impedance characteristics in the "X" direction as well. From the foregoing description, it is apparent that the left and right diagrams have high-impedance characteristics at the same frequency band.

Figure 12:
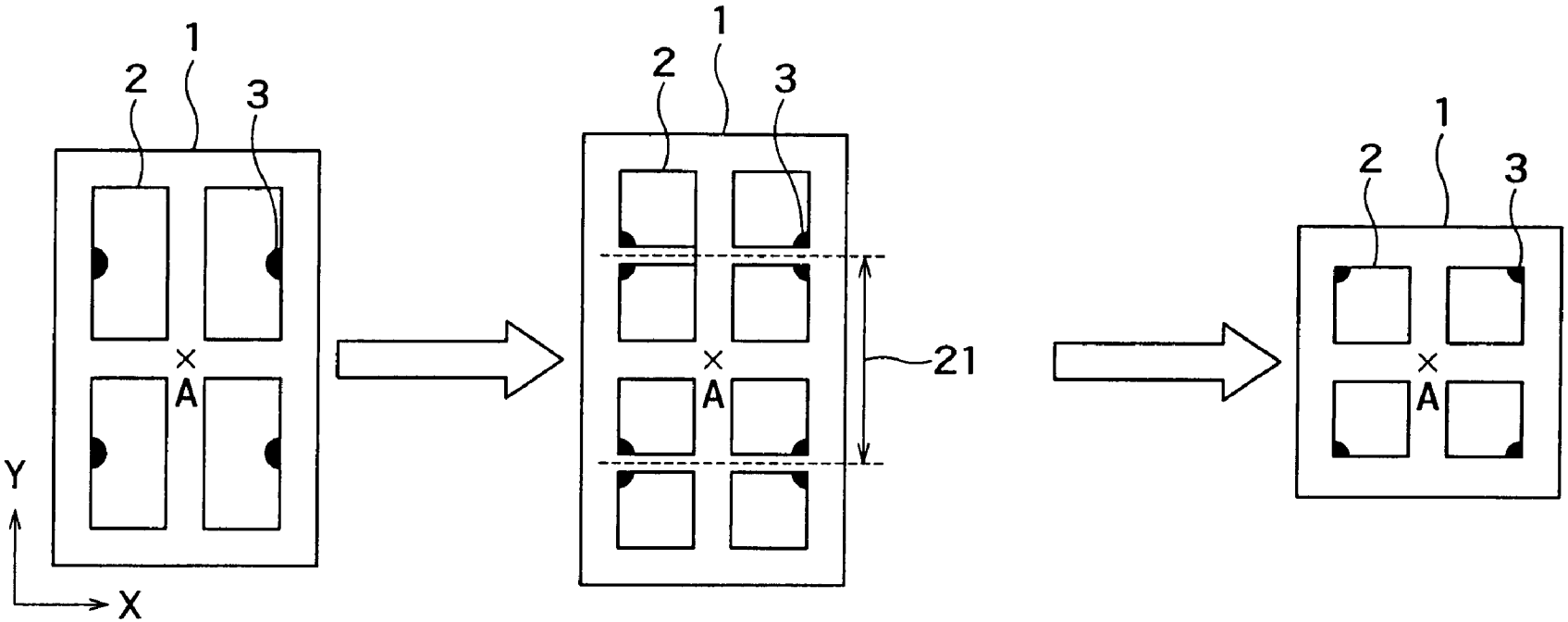
FIG. 12 is a diagram following FIG. 11 which explains the background leading to the present invention.

The left diagram in FIG. 12 is the same as the right diagram in FIG. 11. In the same manner as described with reference to FIG. 11, the metal patches can be cut in the "Y" direction as shown in the center diagram. By arranging the gap created by the cut to be sufficiently narrow, the configuration shown in the center diagram performs the same operation as those of the left diagram with respect to high frequencies. A portion 21 shown in the center diagram, which is now considered to be one period in the "Y" direction, is extracted and shown in the right diagram. Since one period in the "Y" direction was extracted, the high-impedance characteristics in the "X" direction are exactly the same as those of the center diagram. In addition, since the structure shown in the right diagram is rotationally symmetric, the same high-impedance characteristic as the "X" direction is also exhibited in the "Y" direction in the same frequency band. From the above description, the high-impedance substrate shown in the right diagram exhibits high-impedance characteristics in exactly the same frequency band as that of the left diagram. In other words, when considered in combination with FIG. 11, the high-impedance substrate shown in the left diagram in FIG. 11 and the high-impedance substrate shown in the right diagram in FIG. 12 achieve approximately the same high-impedance characteristics at the same frequency band regardless of the fact that the area has been reduced to ¼.

While a case of 1 period by 1 period (2 rows by 2 columns) has been described with reference to FIGS. 11 and 12, the same reasoning applies to a case of "M" periods (M+1 rows) by "N" periods (N+1 columns), where "M" and "N" are integers equal to or greater than 3. The downsized high-impedance substrate shown in FIG. 1 is obtained by performing the operations of FIGS. 11 and 12 on 1 period (2 rows) by 4 periods (5 columns).

Figure 13:
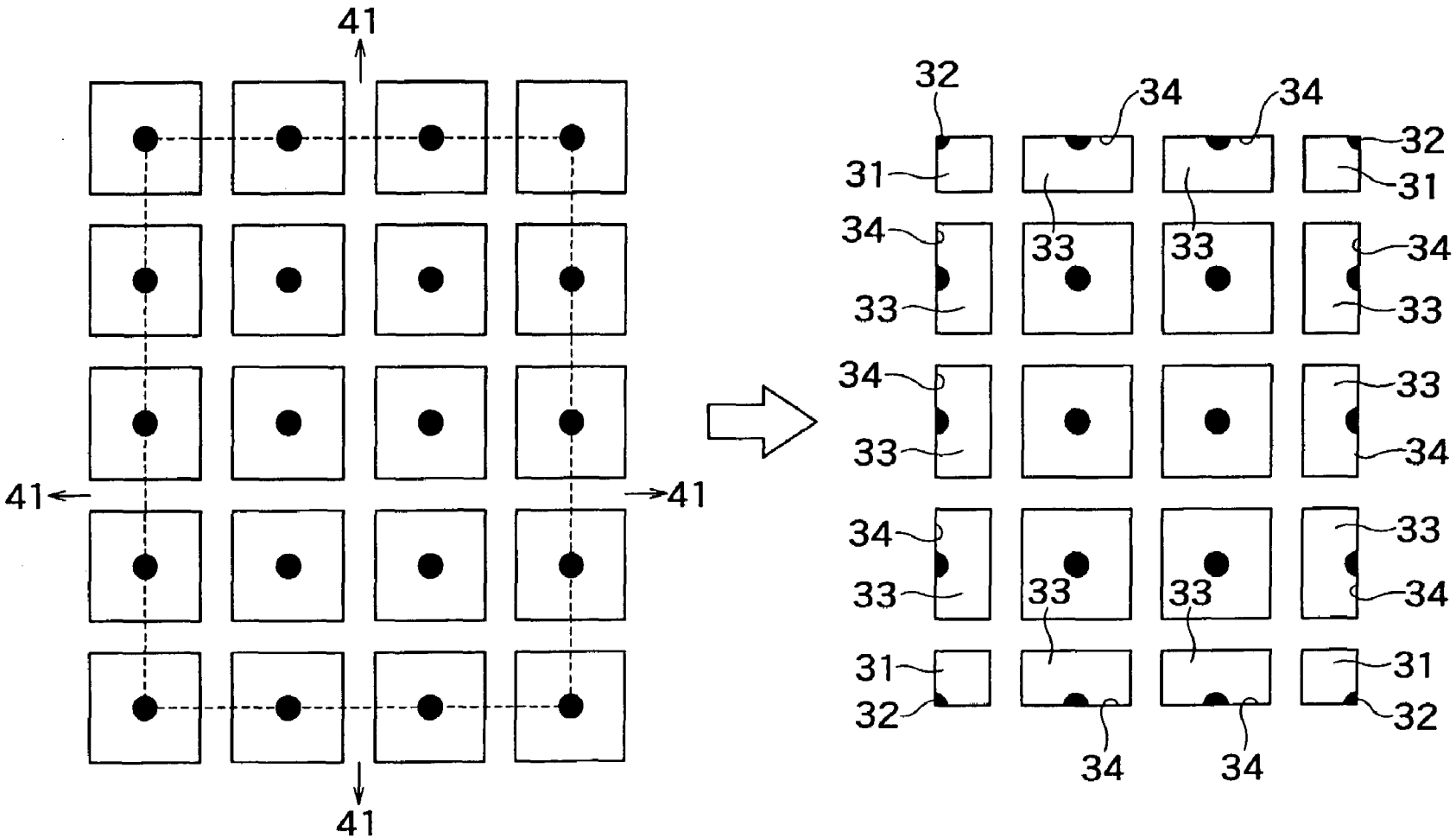
FIG. 13 is a diagram showing a comparison between a high-impedance substrate having a 4-row, 5-column arrangement of metal patches and a conventional art.

An example in which the operations of FIGS. 11 and 12 are performed on a high-impedance substrate in the case of 4 periods (5 rows) by 3 periods (4 columns) is shown in FIG. 13. By performing the operations of FIGS. 11 and 12 on the high-impedance substrate shown in the left diagram, downsizing of the high-impedance substrate may be performed as shown in the right diagram. While the effects of downsizing are sacrificed by the cutoff position (the dotted line in the left diagram) when performing the operations of FIGS. 11 and 12, the position may be expanded outwards in the directions 41. As is apparent from the right diagram, the areas of the metal patches arranged at the outermost periphery are smaller than the planar areas of the metal patches arranged inside the metal patches arranged at the outermost periphery. The outer metal patches arranged at the outermost periphery are connected with linear conductors at their edges (outer peripheral portions). In addition, among the outer metal patches arranged at the outermost periphery, metal patches (first metal patches) 31 that are arranged at corners (intersections of lateral (row-wise) metal patch rows and longitudinal (column-wise) metal patch columns) are connected with linear conductors at intersections 32 of sides on which an adjacent metal patch does not exist, while metal patches (second metal patches) 33 other than the metal patches 31 among the outer metal patches are connected with linear conductors at the center of a side 34 on which an adjacent metal patch does not exist. While the metal patches arranged inside the outer metal patches are connected with linear conductors at their center portions, these positions may be altered according to desired impedance characteristics.

From the description with reference to FIGS. 11 and 12, the following is true when the gaps between adjacent metal patches are narrow in comparison to the length of one side of a metal patch 2. That is, a conventional M-row, N-column high-impedance, where "M" and "N" are integers equal to or greater than 2, may be downsized by the present embodiment to an area of (M−1) by (N−1). Moreover, the characteristics as a high-impedance substrate hardly change, if at all.

Second Embodiment

Figure 2:
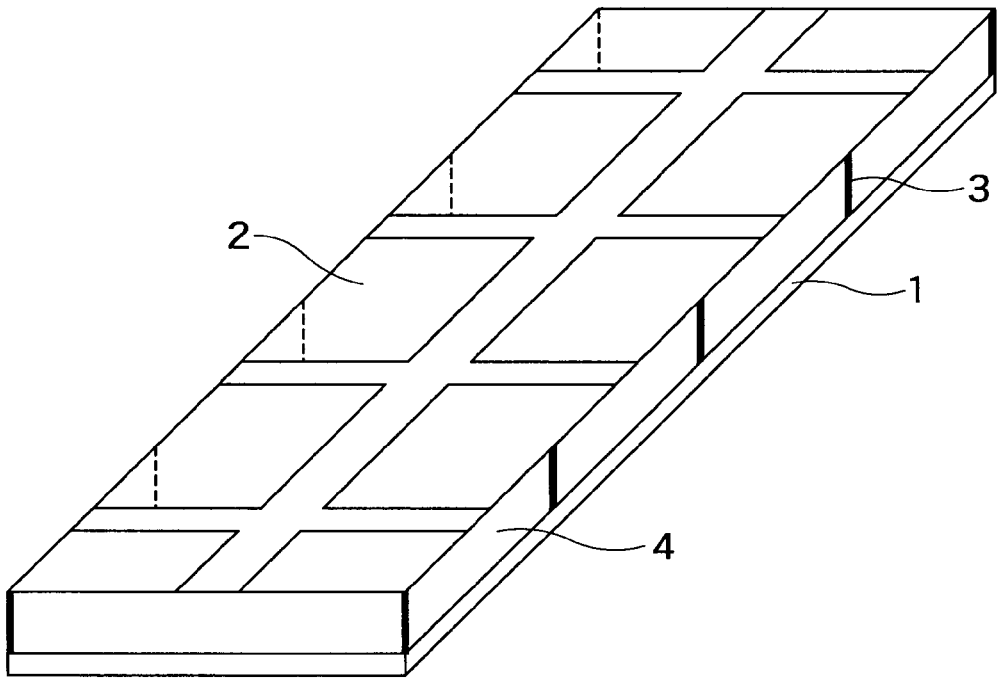
FIG. 2 is a configuration diagram of a high-impedance substrate according to a second embodiment.

FIG. 2 is a configuration diagram of a high-impedance substrate according to a second embodiment of the present invention. This high-impedance substrate is configured such that a dielectric substrate 4 is provided on the finite ground plane 1 of the high-impedance substrate shown in FIG. 1. The finite ground plane 1 comes into contact with one face (rear face) of the dielectric substrate 4, and metal patches 2 are arranged in a matrix pattern on the face of the dielectric substrate 4 opposite to the finite ground plane 1 (front face). Linear conductors 3 that short-circuit the metal patches 2 and the finite ground plane 1 are formed on the side faces (lateral faces) of the dielectric substrate 4. In this case, while metal patches are arranged in a 2 by 5 matrix pattern, for arrangements having a larger number of metal patches such as 5 by 5, linear conductors connected with the metal patches inside the outer metal patches of the outermost periphery penetrate the interior of the dielectric substrate 4 and come into contact with the finite ground plane 1.

The present structure can be entirely implemented by etching and metal plating or wire bonding on a so-called dielectric substrate frequently used in circuit implementation and the like.

For example, both the structures of the finite ground plane 1 and the metal patches 2 may be formed by performing etching on a double-sided blank PCB in which two faces (front and rear faces) of the dielectric substrate 4 are covered with metal.

Since the purpose of the linear conductors 3 are to short-circuit the finite ground plane 1 and the metal patches 2, the linear conductors 3 may be produced by wire bonding in which a metal wire is stretched across the lateral face of the dielectric substrate 4 and the metal wire is soldered to the finite ground plane 1 and the metal patches 2 or by metal-plating the lateral face of the dielectric substrate 4. Alternatively, the linear conductors 3 may be manufactured by etching a metal-covered lateral face of the dielectric substrate to form striplines. In other words, providing short circuit lines on the edge (lateral face) of the dielectric substrate 4 eliminates the need for a conventional through-hole process, and enables manufacturing using basic face printing techniques. As a result, manufacturing becomes easier.

According to the above configuration, in addition to achieving the same effects as in the first embodiment, the entire structure can now be supported by the dielectric substrate 4, and downsizing can be achieved due to the permittivity of the dielectric substrate 4. In addition, since manufacturing can be performed using basic substrate processing techniques such as etching, cost reduction can be achieved. Furthermore, since it is now possible to visually verify whether a linear conductor 3 is disconnected, product inspection can be carried out in an easy manner.

It should be noted that a high-impedance substrate of an arbitrary size may be easily manufactured by combining a plurality of 2 by 2 high-impedance substrates (refer to the right diagram in FIG. 12) to which the present embodiment has been applied and which have dielectric substrates. For example, arranging four 2 by 2 high-impedance substrates having dielectric substrates in a column-wise direction results in the high-impedance substrate shown in FIG. 2. A detailed description thereof will now be provided.

One side of a metal patch is, for example, several tens of millimeters, and the spacing between metal patches is, for example, a fraction of a millimeter. As is conventional, with a high-impedance substrate provided with short circuit lines at the center of the metal patches (refer to the left diagram in FIG. 11 or the left diagram in FIG. 13), there is a need to manufacture a large high-impedance substrate by arranging a plurality of metal patches at spacing of a fraction of a millimeter. However, arranging metal patches at spacing of a fraction of a millimeter is difficult, and the smallest of errors (few tenths of a millimeter) may have a significant impact on performance. Conversely, by combining a plurality of 2 by 2 high-impedance substrates to which the present embodiment has been applied (by connecting the sides of metal patches), a larger high-impedance substrates can be easily manufactured. In this case, since a side of a metal patch has a length of several tens of millimeters as described above, a small error (few tenths of a millimeter) has hardly any impact on performance. In addition, a 2 by 2 high-impedance substrate can be easily manufactured by etching or the like.

As seen, a high-impedance substrate of an arbitrary size may be easily manufactured by liberally combining 2 by 2 high-impedance substrates. Consequently, the size of a high-impedance substrate can be easily changed according to the size of a chassis on which an antenna or an antenna device is to be installed. While an example has been described in which 2 by 2 high-impedance substrates to which the present embodiment has been applied and which have dielectric substrates are combined, a high-impedance substrate of an arbitrary size may be easily manufactured for the same reasons as described above by liberally combining 2 by 2 high-impedance substrates to which the present embodiment has been applied which do not have dielectric substrates.

Third Embodiment

Figure 3:
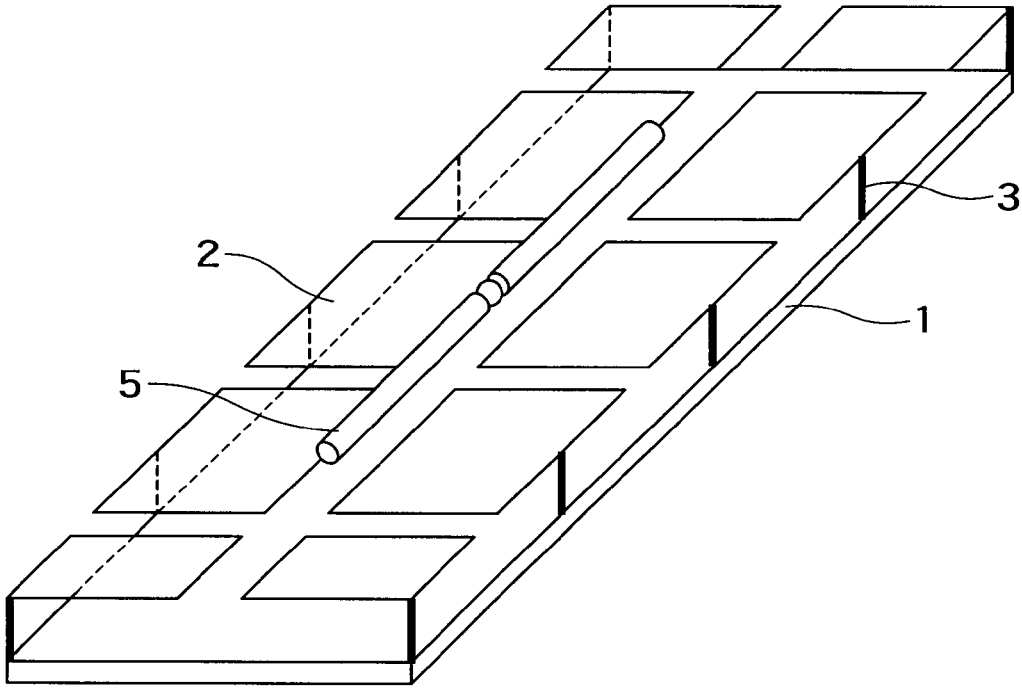
FIG. 3 is a configuration diagram of an antenna device according to a third embodiment.

FIG. 3 is a configuration diagram of an antenna device according to a third embodiment of the present invention. For this antenna device, a dipole antenna 5 has been provided on the high-impedance substrate shown in FIG. 1 at a height that is equal to or higher than the metal patches.

Since all of the components other than the dipole antenna 5 are the same as those of the first embodiment, a description thereof will be omitted.

The dipole antenna 5 is arranged straight in the longitudinal direction of the high-impedance substrate, and is arranged at the center of the gap between rows of metal patches.

According to the configuration described above, a low profile of the dipole antenna can be adopted. The reason for this will now be described.

Since the structure other than the dipole antenna is the same as the high-impedance substrate according to the first embodiment, the configuration has high-impedance characteristics at a specific frequency band. At this frequency, it is unlikely that a high-frequency current will flow in a direction parallel to the finite ground plane 1. Conversely, in the case where there are no metal patches and only the finite ground plane 1 exists, current flows freely over the finite ground plane 1 and a state is attained which is the same as a state where a so-called image current is assumed in a free space. Since this image current cancels the current flowing through the dipole antenna 5 and impedes the radiation of electromagnetic waves, in the case of an antenna device without metal patches, it is necessary to position the dipole antenna 5 away from the finite ground plane 1. However, with the antenna device according to the present embodiment, although a current is actually generated on the finite ground plane 1 so as to be equivalent to the image current, the image current is suppressed in frequency bands in which current hardly flows through the high-impedance substrate. As a result, radiation of electromagnetic waves may be obtained even when bringing the dipole antenna 5 close to the high-impedance substrate. Therefore, a low profile can be adopted for the dipole antenna 5.

Fourth Embodiment

Figure 4:
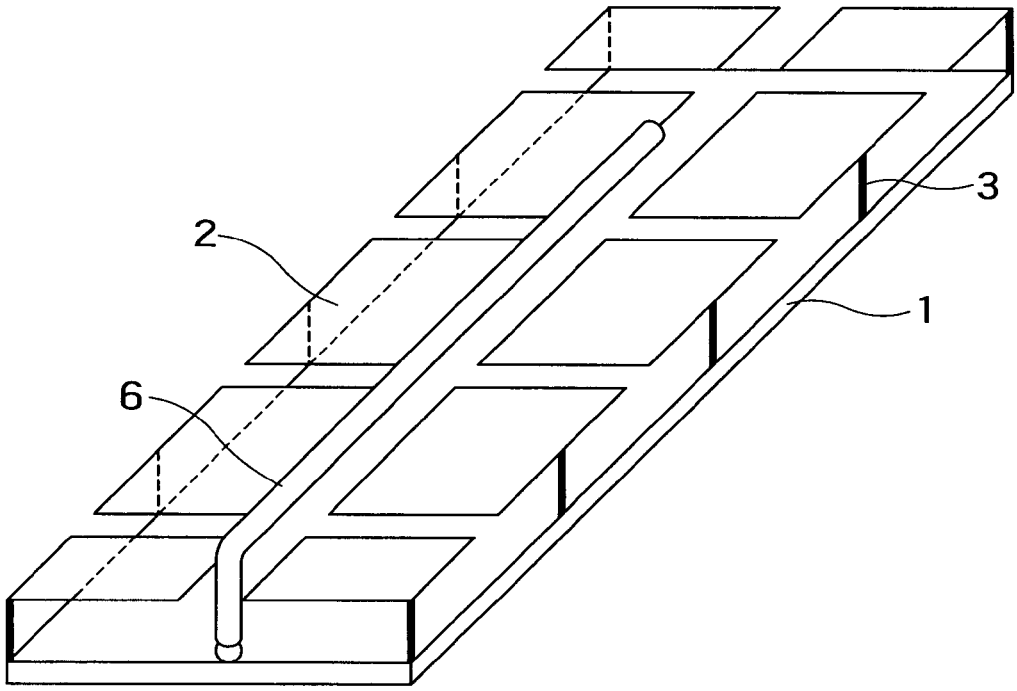
FIG. 4 is a configuration diagram of an antenna device according to a fourth embodiment.

FIG. 4 is a configuration diagram of an antenna device according to a fourth embodiment of the present invention. For this antenna device, a monopole antenna 6 has been provided on the high-impedance substrate shown in FIG. 1 at a height that is equal to or higher than the metal patches.

According to the configuration described above, a low profile can be adopted for the monopole antenna 6 for the same reasons as in the third embodiment.

Fifth Embodiment

Figure 5:
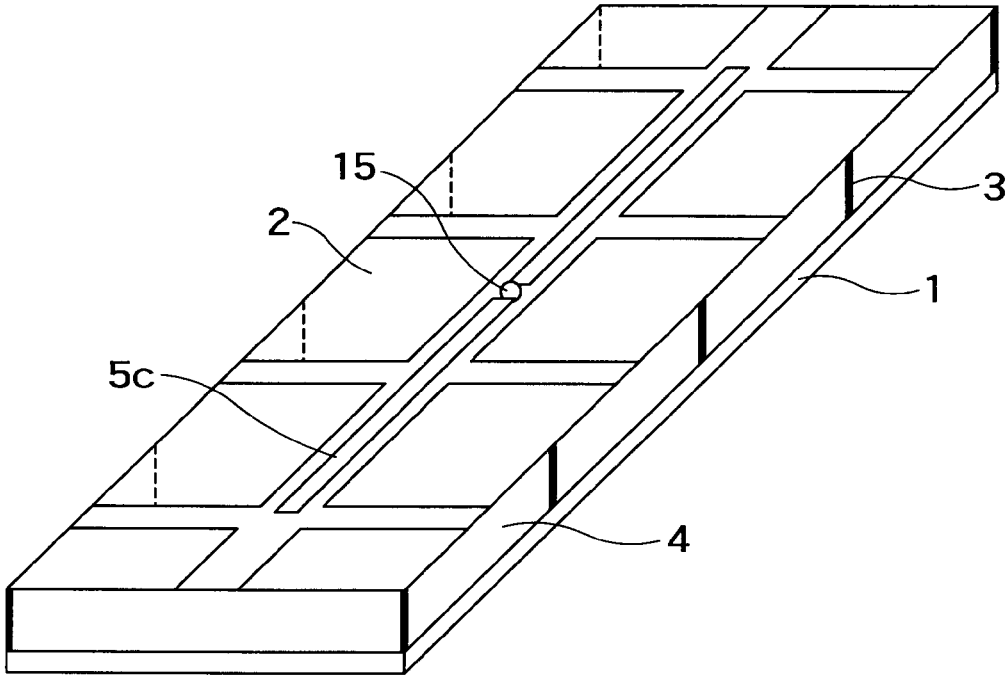
FIG. 5 is a configuration diagram of an antenna device according to a fifth embodiment.

FIG. 5 is a configuration diagram of an antenna device according to a fifth embodiment of the present invention. For this antenna device, a dipole antenna 5*c* has been provided on the front face of the dielectric substrate 4 in the high-impedance substrate shown in FIG. 2. The dipole antenna 5*c* is arranged straight in the longitudinal direction of the high-impedance substrate, and is arranged at the center of the gap between rows of metal patches.

Since all of the components other than the dipole antenna 5*c* are the same as those of the second embodiment, a description thereof will be omitted.

In the same manner as the metal patches 2, the dipole antenna 5*c* may be formed as a stripline on the dielectric substrate by etching.

According to the configuration described above, in addition to achieving the same effects as in the second embodiment, the entire structure including the antenna and the high-impedance substrate can now be produced using basic substrate processing techniques such as etching, thereby achieving cost reduction.

Figure 9:
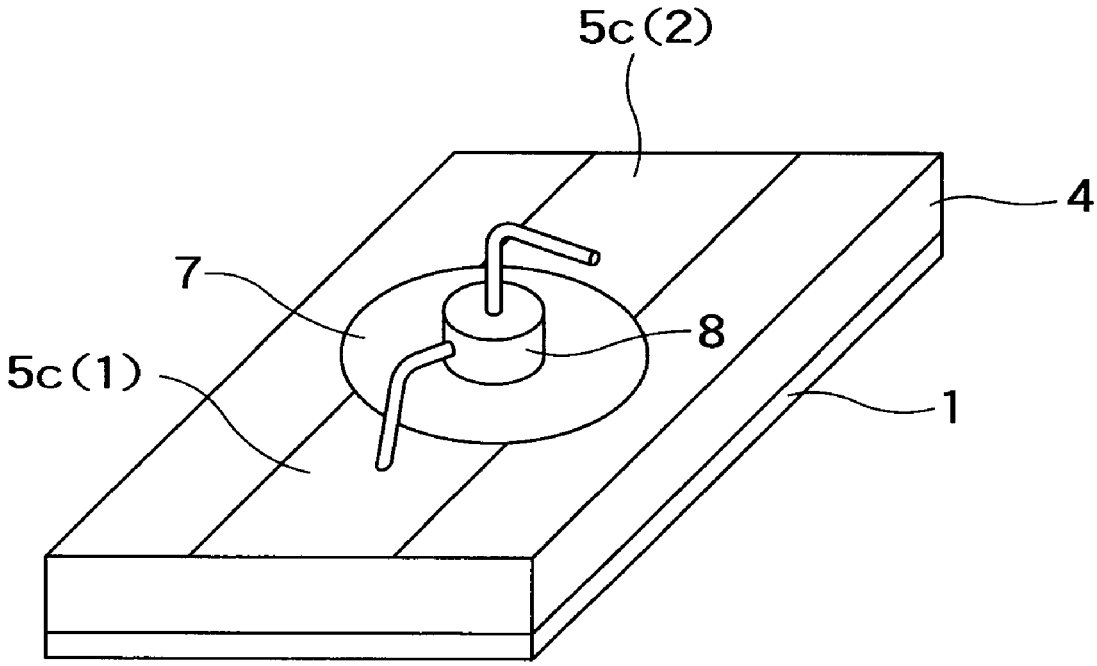
FIG. 9 is an enlarged view of a vicinity of a feeding point in the antenna device according to the fifth embodiment.

A detailed description will now be given on an implementation at a vicinity of a feeding point 15 of the dipole antenna 5*c*. FIG. 9 is an enlarged view of the vicinity of the feeding point 15 shown in FIG. 5. A hole 7 is formed on the dielectric substrate 4 in the vicinity of the feeding point. Feeding is performed via a coaxial line 8 from the rear face of the finite ground plane 1. The coaxial line 8 penetrates the interior of the dielectric substrate 4. The outer conductor of the coaxial line 8 short-circuits one stripline 5*c*(1) of the dipole antenna 5*c*, while the inner conductor short-circuits the other stripline 5*c*(2). Since the thickness of the coaxial line 8 is generally extremely small compared to a wavelength, deterioration of characteristics of the high-impedance substrate due to the formation of the hole 7 is virtually nonexistent.

Sixth Embodiment

Figure 6:
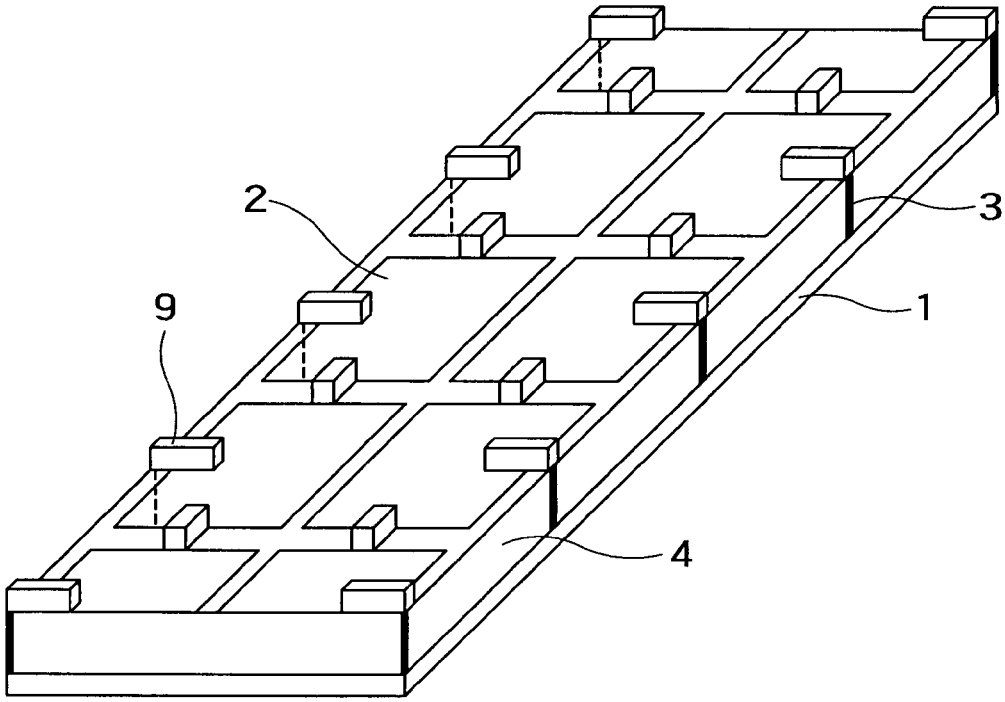
FIG. 6 is a configuration diagram of a high-impedance substrate according to a sixth embodiment.

FIG. 6 is a configuration diagram of a high-impedance substrate according to a sixth embodiment of the present invention. For this high-impedance substrate, variable reactance elements 9 have been provided between adjacent metal patches 2 and at contacts between the metal patches 2 and the linear conductors 3 in the high-impedance substrate shown in FIG. 2. Reactance elements may be used in place of the variable reactance elements 9.

Since all of the components other than the variable reactance elements 9 are the same as those of the second embodiment, a description thereof will be omitted.

A variable reactance element 9 is a high-frequency component capable of varying the reactance value between terminals thereof. A conductor such as a variable capacitance diode, a combination of a switch and a fixed reactance element, or a MEMS (MicroElectroMagnetic Systems) element may be used.

According to the configuration described above, in addition to achieving the same effects as in the second embodiment, the frequency band at which high-frequency characteristics are attained can be varied.

Seventh Embodiment

Figure 7:
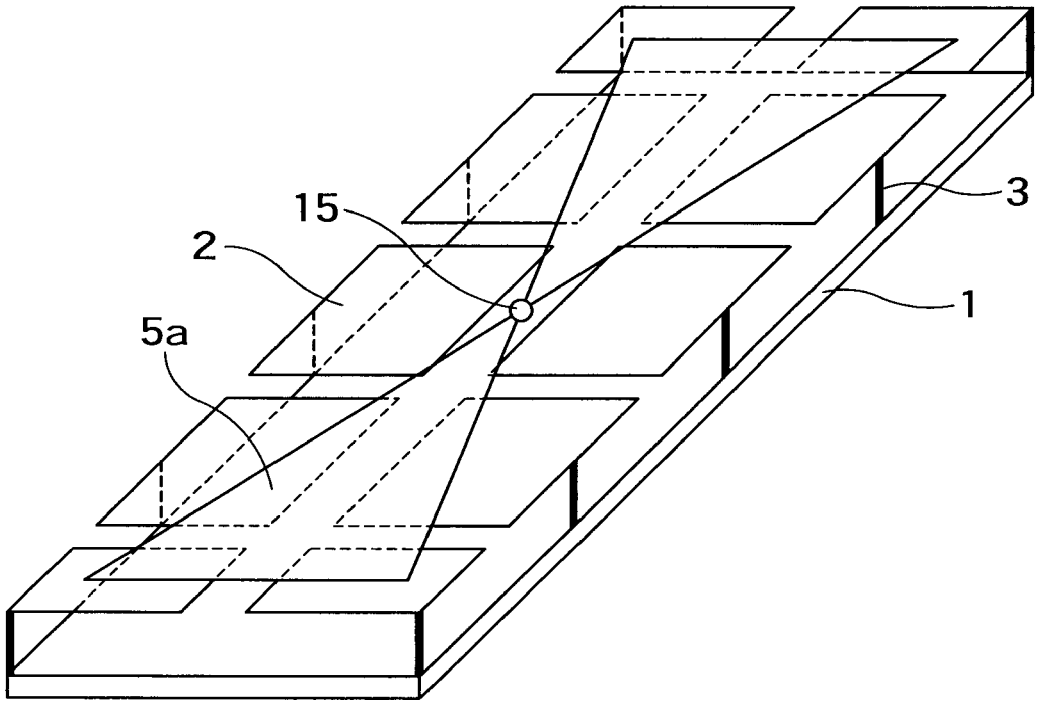
FIG. 7 is a configuration diagram of an antenna device according to a seventh embodiment.

FIG. 7 is a configuration diagram of an antenna device according to a seventh embodiment of the present invention. For this antenna device, a bowtie dipole antenna 5*a* has been provided on the high-impedance substrate shown in FIG. 1 at a height that is slightly higher than the metal patches 2. The bowtie dipole antenna 5*a* is arranged so as to extend in the longitudinal direction of the high-impedance substrate, and is arranged at the center of the gap between rows of metal patches.

Since all of the components other than the bowtie dipole antenna 5*a* are the same as those of the first embodiment, a description thereof will be omitted.

The bowtie dipole antenna 5*a* is constituted by a conductor plate and has a shape that widens as the distance from the feeding point 15 increases, and is an antenna having a wider band than the dipole antenna 5. According to the configuration described above, the bowtie dipole antenna 5*a* achieves adoption of a low profile in the same manner as the dipole antenna according to the third embodiment. This is because, as described with respect to the first embodiment, since the high-impedance substrate has high-impedance characteristics in the longitudinal direction of the antenna as well as in a direction perpendicular thereto, currents do not flow even if the bowtie dipole antenna 5*a* attempts to do so in various directions on the finite ground plane 1.

Eighth Embodiment

Figure 8:
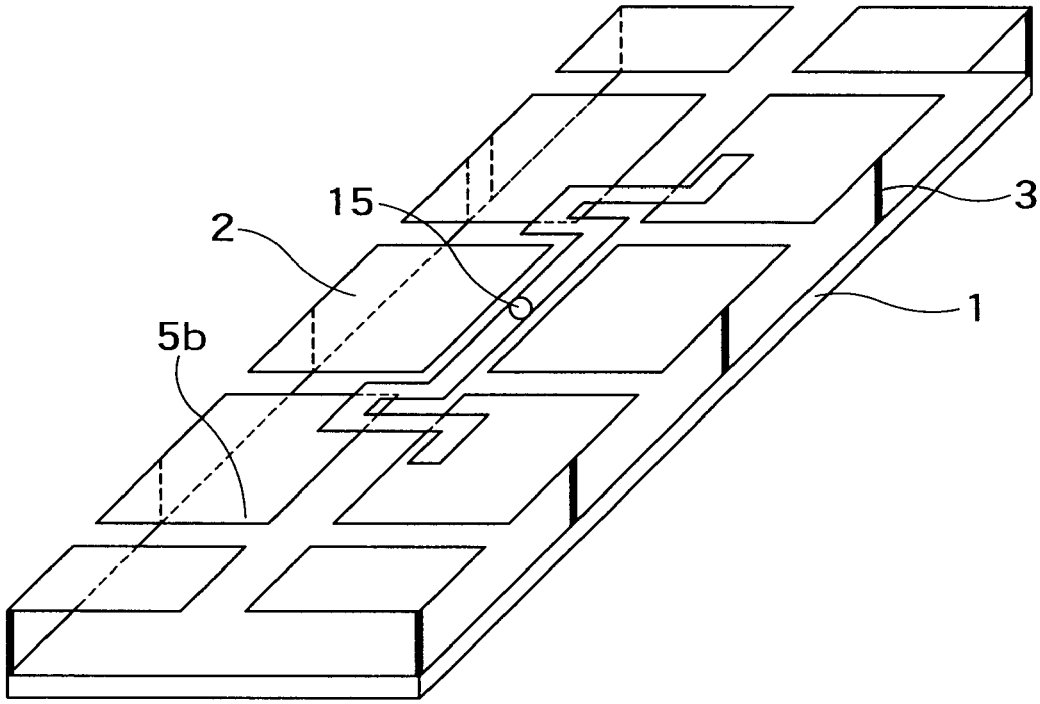
FIG. 8 is a configuration diagram of an antenna device according to an eighth embodiment.

FIG. 8 is a configuration diagram of an antenna device according to an eighth embodiment of the present invention. For this antenna device, a meander dipole antenna 5*b* has been provided on the high-impedance substrate shown in FIG. 1 at a height that is slightly higher than the metal patches 2. The meander dipole antenna 5*b* is arranged so as to extend in the longitudinal direction of the high-impedance substrate, and is arranged at the center of the gap between rows of metal patches.

Since all of the components other than the meander dipole antenna 5*b* are the same as those of the first embodiment, a description thereof will be omitted.

The meander dipole antenna 5*b* is constituted by a meander-shape linear conductor, and is an antenna whose longitudinal length is shorter than that of the dipole antenna 5*c* shown in FIG. 5.

According to the configuration described above, the meander dipole antenna 5*b* achieves adoption of a low profile in the same manner as the dipole antenna according to the third embodiment. This is because, as described with respect to the first embodiment, since the high-impedance substrate has high-impedance characteristics in the longitudinal direction of the antenna as well as in a direction perpendicular thereto, currents do not flow even if the meander dipole antenna 5*b* attempts to do so in various directions on the finite ground plane 1.

Ninth Embodiment

Figure 14:
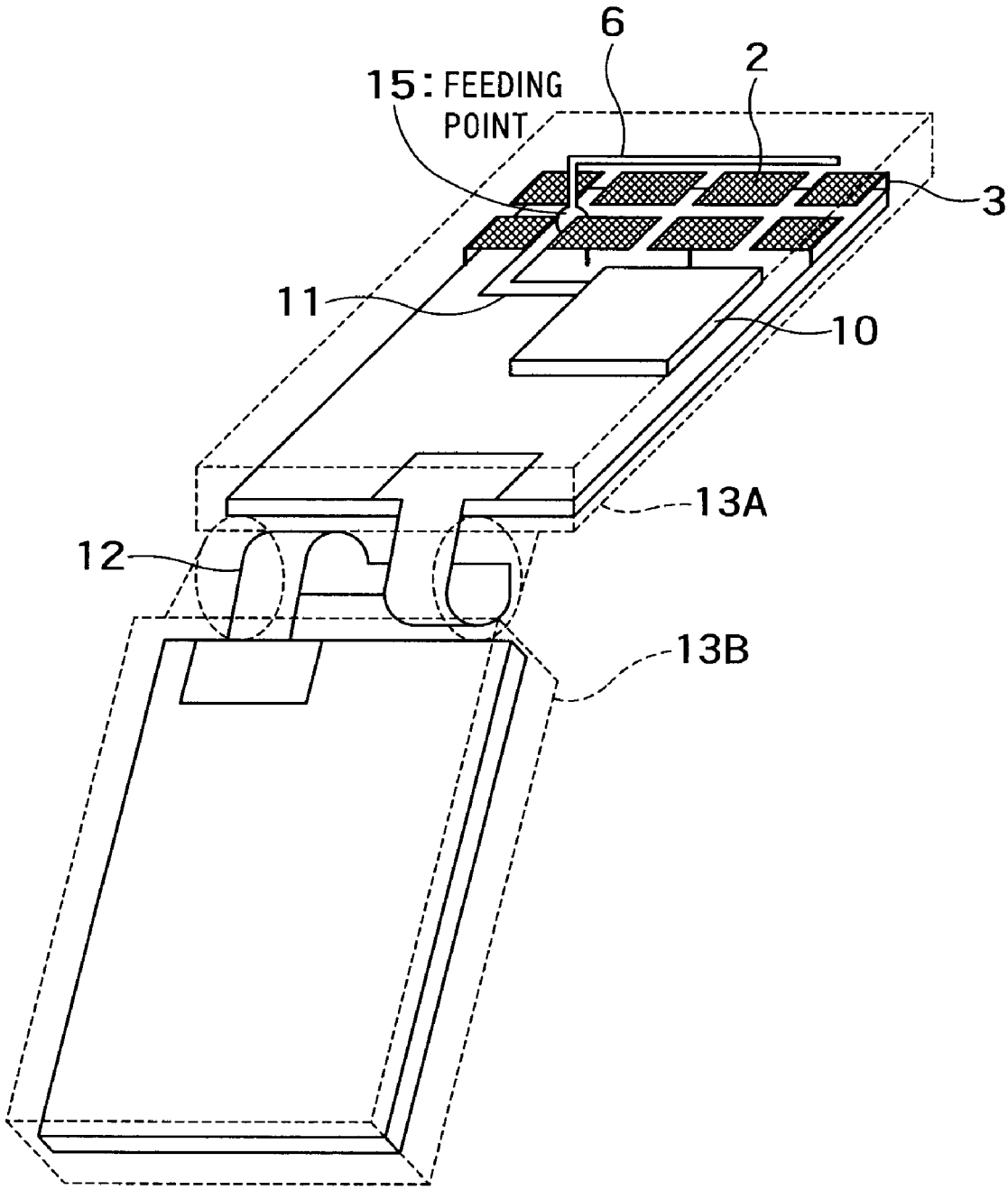
FIG. 14 is a configuration diagram of a mobile radio device according to a ninth embodiment.

FIG. 14 is a configuration diagram of a mobile radio device (mobile phone) according to a ninth embodiment of the present invention.

Two chassis 13A and 13B are coupled so as to be openable and closable by a hinge cable 12. Mounted inside the chassis 13A are: a high-impedance substrate on which a monopole antenna 6 is mounted (refer to FIG. 4); a radio circuit 10 that generates a high-frequency current; and a feeding line 11 that supplies the high-frequency current generated by the radio circuit 10 to a feeding point 15 of the monopole antenna 6. While the radio circuit 10 is arranged on a finite ground plane of the high-impedance substrate, a plate on which the radio circuit 10 is mounted may differ from the plate of the high-impedance substrate. Since this high-impedance substrate is downsized, mounting on the radio device can be easily performed. While an example using a high-impedance substrate on which a monopole antenna is mounted has been shown in FIG. 14, it is obvious that a high-impedance substrate mounted with other antennas such as a dipole antenna, a meander antenna or a bowtie antenna may also be used.

What is claimed is:

1. A high-impedance substrate comprising:

a finite ground plane;

a plurality of metal plates arranged at a predetermined height from the finite ground plane and in a matrix pattern such that respective faces thereof are approximately parallel to the finite ground plane; and a plurality of linear conductive elements configured to connect the plurality of metal plates to the finite ground plane and, wherein the plurality of metal plates comprises outer plates arranged at an outermost periphery and inner metal plates, and a planar area of the outer metal plates is smaller than a planar area of inner metal plates different from the outer metal plates among the metal plates, and the outer metal plates are connected with the linear conductive elements at edges of the outer metal plates.

2. The high-impedance substrate according to claim 1, wherein the metal plates have rectangular planar shapes, and first metal plates arranged at corners among the outer metal plates are connected with the linear conductive elements at intersections of sides on which an adjacent metal plate does not exist.

3. The high-impedance substrate according to claim 2, wherein second metal plates other than the first metal plates among the outer metal plates are connected with linear conductive elements at a side on which an adjacent metal plate does not exist.

4. The high-impedance substrate according to claim 3, wherein the linear conductive elements connected with the second metal plates are connected at a center of the side of the second metal plates.

5. The high-impedance substrate according to claim 1, further comprising a dielectric substrate provided on the finite ground plane, wherein the plurality of metal plates is arranged on a front face of the dielectric substrate.

6. The high-impedance substrate according to claim 5, wherein the linear conductive elements connected with the outer metal plates are formed on a side face of the dielectric substrate.

7. The high-impedance substrate according to claim 1, further comprising reactance elements or variable reactance elements which connect adjacent metal plates each other.

8. The high-impedance substrate according to claim 1, further comprising reactance elements or variable reactance elements between the outer metal plates and linear conductive elements connected with the outer metal plates.

9. An antenna device comprising the high-impedance substrate according to claim 1 and a monopole antenna or a dipole antenna at the predetermined height from the finite ground plane or at a higher height.

10. The antenna device according to claim 9, wherein the dipole antenna is a bowtie dipole antenna or a meander dipole antenna.

11. The antenna device according to claim 9, further comprising:

a dielectric substrate provided on the finite ground plane; and a coaxial line configured to feed to a feeding point of the dipole antenna, wherein the plurality of metal plates are arranged on a front face of the dielectric substrate, the dipole antenna is arranged on the front face of the dielectric substrate or at a higher height, and the coaxial line is configured to penetrate the interior of the dielectric substrate from a rear face to the front face thereof.

12. A portable radio device comprising:

a high-impedance substrate including a finite ground plane, a plurality of metal plates arranged at a predetermined height from the finite ground plane and in a matrix pattern such that respective faces thereof are approximately parallel to the finite ground plane, and a plurality of linear conductive elements configured to connect the plurality of metal plates to the finite ground plane and, wherein the plurality of metal plates comprises outer plates arranged at an outermost periphery and inner metal plates, and a planar area of the outer metal plates is smaller than a planar area of inner metal plates different from the outer metal plates among the metal plates, and the outer metal plates are connected with the linear conductive elements at edges of the outer metal plates;

an antenna arranged at a predetermined height from the finite ground plane or at a higher height;

a radio circuit configured to generate high-frequency current; and a feeding line configured to supply high-frequency current generated by the radio circuit to a feeding point of the antenna.

13. A high-impedance substrate comprising:

a finite ground plane;

2 by "n" (where "n" is an integer equal to or greater than 2) number of metal plates arranged at a predetermined height from the finite ground plane and in a 2-row matrix pattern such that respective faces thereof are approximately parallel to the finite ground plane; and 2 by "n" number of linear conductive elements configured to connect the metal plates to the finite ground plane and, wherein a planar area of first metal plates arranged at corners among the 2 by "n" number of metal plates are smaller than a planar area of second metal plates other than the first metal plates among the 2 by "n" number of metal plates, the first metal plates are connected with the linear conductive elements at intersections of sides on which an adjacent metal plate does not exist, and the second metal plates are connected with linear conductive elements at a side on which an adjacent metal plate does not exist.

14. The substrate according to claim 2, wherein the inner metal plates are connected with the liner conductive elements at centers thereof, a planer area of each first metal plate is one-fourth of a planer area of each inner metal plate.

15. The substrate according to claim 3, the metal plates have rectangular planar shapes, the inner metal plates are connected with the liner conductive elements at centers thereof, the linear conductive elements connected with the second metal plates are connected at a center of the side of the second metal plates, a planer area of each second metal plate is a half of a planer area of each inner metal plate.

16. The substrate according to claim 13, wherein the metal plates have rectangular planar shapes, the second metal, plates are connected with the liner conductive elements at a center of the side of the second metal plates, and a planer area of each first metal plate is a half of a planer area of each second metal plate.

* * * * *